US006611230B2

(12) United States Patent
Phelan

(10) Patent No.: US 6,611,230 B2
(45) Date of Patent: Aug. 26, 2003

(54) PHASED ARRAY ANTENNA HAVING PHASE SHIFTERS WITH LATERALLY SPACED PHASE SHIFT BODIES

(75) Inventor: Harry Richard Phelan, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/735,278

(22) Filed: Dec. 11, 2000

(65) Prior Publication Data

US 2002/0070896 A1 Jun. 13, 2002

(51) Int. Cl.[7] ..... H01P 1/18; H01Q 3/36
(52) U.S. Cl. ..... 342/373; 333/161
(58) Field of Search ..... 333/161, 156; 342/372, 373

(56) References Cited

U.S. PATENT DOCUMENTS

| | | | | |
|---|---|---|---|---|
| 4,323,901 A | | 4/1982 | De Wames et al. | 343/754 |
| 5,206,613 A | | 4/1993 | Collier et al. | 333/156 |
| 5,302,959 A | * | 4/1994 | Harrington et al. | 333/161 X |
| 5,305,009 A | | 4/1994 | Goutzoulis et al. | 342/157 |
| 5,309,166 A | | 5/1994 | Collier et al. | 343/778 |
| 5,334,958 A | * | 8/1994 | Babbitt et al. | 333/161 X |
| 5,450,092 A | | 9/1995 | Das | 343/787 |
| 5,472,935 A | | 12/1995 | Yandrofski et al. | 505/210 |
| 5,550,792 A | | 8/1996 | Crandall et al. | 367/155 |
| 5,557,286 A | | 9/1996 | Varadan et al. | 343/700 |
| 5,589,845 A | | 12/1996 | Yandrofski et al. | 343/909 |
| 5,617,103 A | | 4/1997 | Koscica et al. | 343/700 |
| 5,680,141 A | | 10/1997 | Didomenico et al. | 342/372 |
| 5,693,429 A | | 12/1997 | Sengupta et al. | 428/699 |
| 5,694,134 A | | 12/1997 | Barnes | 343/700 |
| 5,696,737 A | | 12/1997 | Hossack et al. | 367/138 |
| 5,729,239 A | | 3/1998 | Rao | 343/753 |
| 5,731,790 A | | 3/1998 | Riza | 342/368 |
| 5,766,697 A | | 6/1998 | Sengupta et al. | 427/585 |
| 5,830,591 A | | 11/1998 | Sengupta et al. | 428/701 |
| 5,846,893 A | | 12/1998 | Sengupta et al. | 501/137 |
| 5,856,955 A | | 1/1999 | Cole et al. | 367/138 |
| 5,887,089 A | | 3/1999 | Deacon et al. | 385/22 |
| 5,965,494 A | * | 10/1999 | Terashima et al. | 333/99 S X |

* cited by examiner

*Primary Examiner*—Benny T. Lee
(74) *Attorney, Agent, or Firm*—Allen, Dyer, Doppelt, Milbrath & Gilchrist, P.A.

(57) ABSTRACT

A phased array antenna includes a plurality of antenna elements and a phase shifting device connected to the plurality of antenna elements. The phase shifting device includes a substrate, and a plurality of phase shifters on the substrate. Each phase shifter includes a first conductive portion adjacent the substrate and defining a signal path, and a body adjacent the first conductive portion and comprising a phase shifting material having a controllable dielectric constant for causing a phase shift of a signal being conducted through the signal path. The bodies are laterally spaced apart from one another, and may have a thickness equal to or greater than about 0.002 inches. In forming the phased array antenna, each body is bonded to respective signal paths using production surface mount or similar machines.

45 Claims, 5 Drawing Sheets

PHASED ARRAY ANTENNA HAVING PHASE SHIFTERS WITH LATERALLY SPACED PHASE SHIFT BODIES

FIELD OF THE INVENTION

The present invention relates to the field of antennas, and, more particularly, to a phased array antenna.

BACKGROUND OF THE INVENTION

Phased array antennas are well known, and are commonly used in satellite, electronic warfare, radar and communication systems. A phased array antenna includes a plurality of antenna elements and respective phase shifters that can be adjusted for producing a focused antenna beam steerable in a desired direction.

A scanning phased array antenna steers or scans the direction of the RF signal being transmitted therefrom without physically moving the antenna. Likewise, the scanning phased array antenna can be steered or scanned without physically moving the antenna so that the main beam of the phased array antenna is in the desired direction for receiving an RF signal. This enables directed communications in which the RF signal is electronically focused in the desired direction.

Unfortunately, phased array antennas are limited in their application primarily by cost. Even using the latest monolithic microwave integrated circuit (MMIC) technology, an individual phase shifter may have a unit cost in excess of $500. With a typical phased array antenna requiring several thousand antenna elements, each with its own phase shifter, the price of the phased array antenna quickly becomes very expensive.

Attempts have been made to lower the cost of the antenna elements. One type of phase shifter includes switching diodes and transistors that change the path length, and thus the phase shift through the phase shifter via bias current changes.

Another type phase shifter includes a phase shifting material that produces a phase shift via a DC static voltage applied across the material. The dielectric properties of the phase shifting material change under the influence of a controlled voltage. A variable voltage applied to the phase shifting material induces a change in its dielectric constant. As a result, a signal being conducted through a transmission line connected to the phase shifting material exhibits a variable phase delay. In other words, the electrical length of the transmission line can be changed by varying the applied voltage.

For example, U.S. Pat. No. 5,694,134 to Barnes discloses a phased array antenna structure for controlling the beam pattern of a phased array antenna. A thin film of phase shifting material is deposited on the coplanar waveguide and/or the antenna elements. When a variable voltage is applied between the center conductor and the ground structure of the coplanar waveguide, a change in the dielectric constant of the thin film of phase shifting material is induced. As a result, the coplanar transmission line exhibits a variable phase delay.

However, a disadvantage of this approach is that it is difficult to adequately control the dielectric constant of the thin film of phase shifting material since the phase shifting material is adjacent the entire array as one continuous layer. The efficiency of the antenna is reduced since the thin film of phase shifting material increases the loss per unit length in the areas in which it is not phase shifting, i.e., between the phase shifting regions.

Moreover, the thin film is difficult to handle due to its limited thickness, which is several microns or less. The thin film of phase shifting material is typically deposited using evaporation, sputtering or laser beam ablation techniques. Depositing the thin film of phase shifting material using these types of deposition processes also adds to the cost of the phased array antenna. All of these effects result in the Barnes approach not being practical or affordable.

SUMMARY OF THE INVENTION

In view of the foregoing background, it is therefore an object of the present invention to provide a phased array antenna and a method for forming the same at a significantly lower cost than a conventional phased array antenna.

This and other advantages, features and objects in accordance with the present invention are provided by a phased array antenna comprising a plurality of antenna elements and a phase shifting device connected to the plurality of antenna elements. The phase shifting device preferably comprises a substrate, and a plurality of phase shifters on the substrate.

Moreover, each phase shifter preferably comprises a first conductive portion adjacent the substrate and defining a signal path, and a body adjacent the signal path and comprising a phase shifting material having a controllable dielectric constant for causing a phase shift of a signal being conducted through the signal path. The plurality of bodies are preferably laterally spaced apart from one another. The phase shifting material preferably comprises a ferroelectric material, such as barium strontium titanate, or a ferromagnetic material.

In one embodiment, the body preferably comprises a substrate with a layer of the phase shifting material thereon. In another embodiment, the body preferably comprises a bulk phase shifting material body.

The body preferably has an overall thickness equal to or greater than about 0.002 inches. Because the body has a thickness that is relatively easy to handle, it is simply bonded to the signal path in the appropriate place to define a phase shifter. Consequently, instead of individually building the phase shifters and combining them together to form the phased array antenna, the phased array antenna may be built in its entirety by forming the signal paths on the substrate and then bonding the bodies thereto. This advantageously allows low loss transmission media to be used to form the beam combiner and phase shifting material only in the phase shifting regions. In other words, the phased array antenna according to the present invention may be scaled and formed in any desired size, for example.

In forming the phased array antenna, the body is preferably loaded into production surface mount or similar machines. This allows construction of a much lower cost phased array antenna. The present invention is thus very adaptable to mass production using bulk phase shifting material body fabrication techniques.

The phased array antenna may further comprise a summing network connected to the phase shifting device for adding together the signals from the antenna elements. In addition, the phased array antenna may further comprise a beam forming network connected to the phase shifting device for controlling a voltage applied to each body for controlling a respective dielectric constant thereof.

Each phase shifter preferably further comprises at least one second conductive portion adjacent the substrate for defining a ground structure. In one embodiment, the at least one second conductive portion preferably comprises a pair of laterally spaced apart second conductive portions adjacent the substrate and on opposite sides of the signal path. This defines a coplanar waveguide structure. The body is also preferably further adjacent the pair of second conductive portions. In another embodiment, a second conductive portion is vertically spaced from the signal path. This defines a microstrip structure.

Another aspect of the invention relates to a method for making a phase shifting device comprising a substrate and a plurality of phase shifters on the substrate. The method preferably comprises forming a plurality of first conductive portions adjacent the substrate for defining a plurality of signal paths, and positioning a plurality of bodies adjacent the plurality of signal paths.

The plurality of bodies are preferably laterally spaced apart from one another and comprises a phase shifting material have a controllable dielectric constant for causing a phase shift of a signal being conducted through a respective signal path. Positioning each body may be performed using a surface mount machine. Each body may have a thickness equal to or greater than about 0.002 inches.

DETAILED DESCRIPTION OF THE PREFERRED EMBODIMENTS

The present invention will now be described more fully hereinafter with reference to the accompanying drawings in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout the drawings and prime and multiple prime notations are used to describe like elements in alternate embodiments. The dimensions of layers and regions may be exaggerated in the figures for greater clarity.

A phased array antenna 10 in accordance with the present invention will initially be discussed with reference to FIG. 1 and FIGS. 2*a*, 2*b* and 2*c*. The phased array antenna 10 comprises a plurality of antenna elements 12*a*, 12*b* . . . 12*n* and a plurality of phase shifters 14*a*, 14*b* . . . 14*n* connected to the plurality of antenna elements.

Figure 2A:
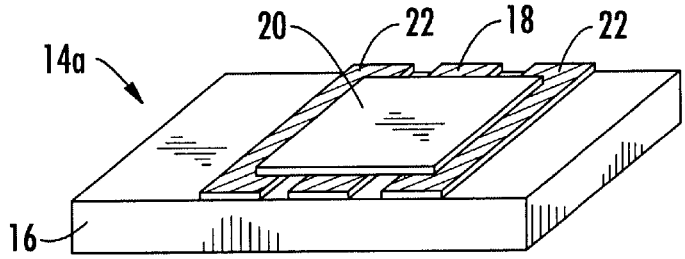
FIGS. 2*a*, 2*b* and 2*c* are perspective views of various embodiments of a phase shifter in accordance with the present invention.

Each phase shifter 14*a*, 14*b* . . . 14*n* comprises a substrate 16, a first conductive portion 18 adjacent the substrate and defining a signal path, and a body 20 adjacent the signal path and comprising a phase shifting material having a controllable dielectric constant for causing a phase shift of a signal being conducted through the signal path, as best shown in FIG. 2*a*. The phase shifting material preferably comprises a ferroelectric material, such as barium strontium titanate, or a ferromagnetic material.

Each of the phase shifters 14*a*, 14*b* . . . 14*n* further includes at least one second conductive portion 22 in a spaced apart relationship to the first conductive portion 18. In one embodiment, the at least one second conductive portion 22 comprises a pair of laterally spaced apart second conductive portions adjacent the substrate 16 for defining a ground structure, as best shown in FIG. 2*a*. The first conductive portion 18 laterally extends between the pair of second conductive portions 22 so that the first conductive portion and the pair of second conductive portions define a coplanar waveguide structure. The body 20 may also be adjacent some or all of the pair of second conductive portions 22.

Figure 2B:
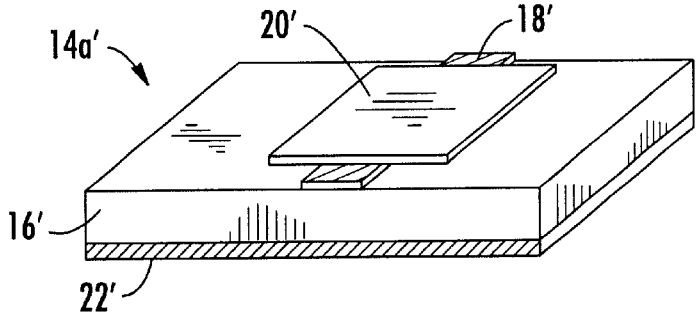

In another embodiment of the phase shifter 14*a'* as shown in FIG. 2*b*, the at least one second conductive portion 22' defines a ground structure adjacent the substrate 16', and is vertically spaced from the first conductive portion 18'. This arrangement defines a microstrip structure as will be readily appreciated by those skilled in the art.

Figure 1:
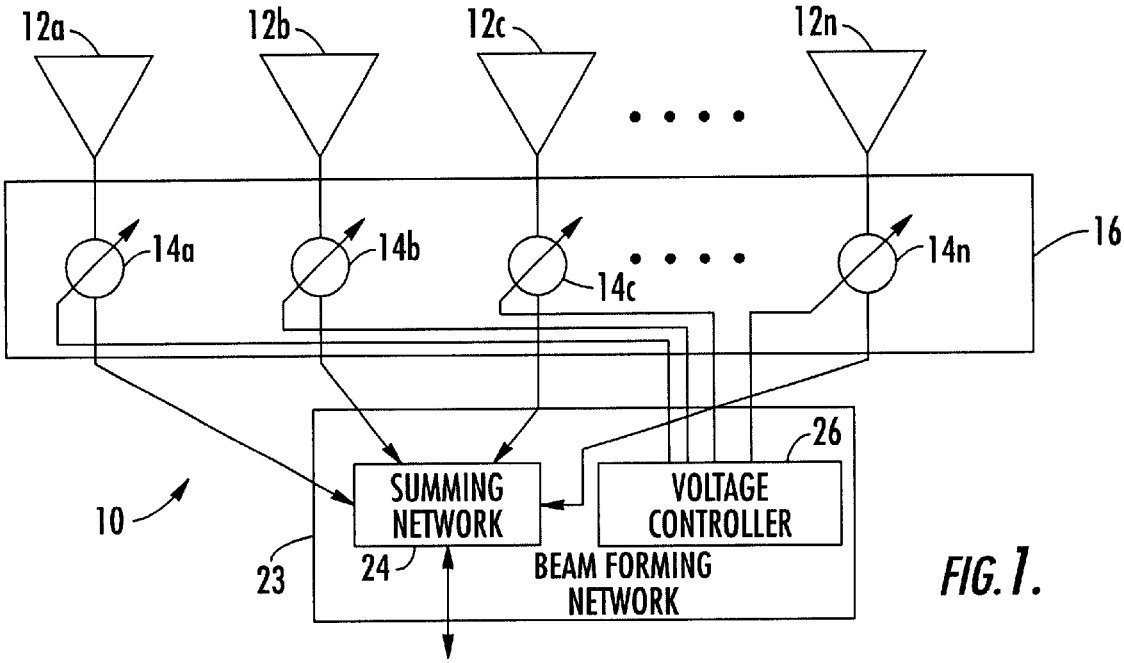
FIG. 1 is a simplified functional block diagram of a phased array antenna in accordance with the present invention.

The phased array antenna as illustrated in FIG. 1 further includes a beam forming network 23 connected to the phase shifting device. The beam forming network 23 includes a summing network 24 connected to the plurality of phase shifters 14*a*, 14*b* . . . 14*n* for adding together the signals received by the antenna elements 12*a*, 12*b* 12*n*. The beam forming network 23 further includes a voltage or bias controller 26 connected to the phase shifting device for controlling a voltage applied to each of the bodies 20 (see FIG 2*a*) for controlling dielectric constants thereof. This permits control of the phase shift of the signal being conducted through the respective signal paths.

The phase of a signal propagating through each phase shifter 14*a*, 14*b* . . . 14*n* varies as a function of the applied voltage, which is typically a DC voltage. In general, the voltage applied to each phase shifter 14*a*, 14*b* . . . 14*n* will be different and may vary at a predetermined rate, thereby causing the phase shifters to produce varying and different phase shifts that result in producing a narrow antenna beam that scans a given direction.

The phase shifters 14*a*, 14*b* . . . 14*n* may be configured as a dedicated receive only function, a dedicated transmit only function, or a combined receive/transmit function, as readily understood by one skilled in the art.

During transmit, RF energy from the phase shifters 14*a*, 14*b* . . . 14*n* drives the antenna elements 12*a*, 12*b* . . . 12*n*. Because the antenna elements 12*a*, 12*b* . . . 12*n* are appropriately spaced at a certain distance and are driven at different phases, a highly directional radiation pattern results that exhibits gain in some directions and little or no radiation in other directions. Consequently, the radiation pattern of the phased array antenna 10 can be steered in a desired direction.

During receive, a reciprocal process takes place. Specifically, the phased array antenna 10 feeds received RF signals to the phase shifters 14*a*, 14*b* . . . 14*n* where they are shifted in phase. Only signals arriving at the antenna elements 12*a*, 12*b* . . . 12*n* from a predetermined direction will add constructively. The predetermined direction is determined by the relative phase shift imparted by the phase shifters 14*a*, 14*b* . . . 14*n* via the voltage controller 26 and the spacing of the antenna elements 12*a*, 12*b* . . . 12*n*, as will be readily appreciated by those skilled in the art.

Figure 5A:
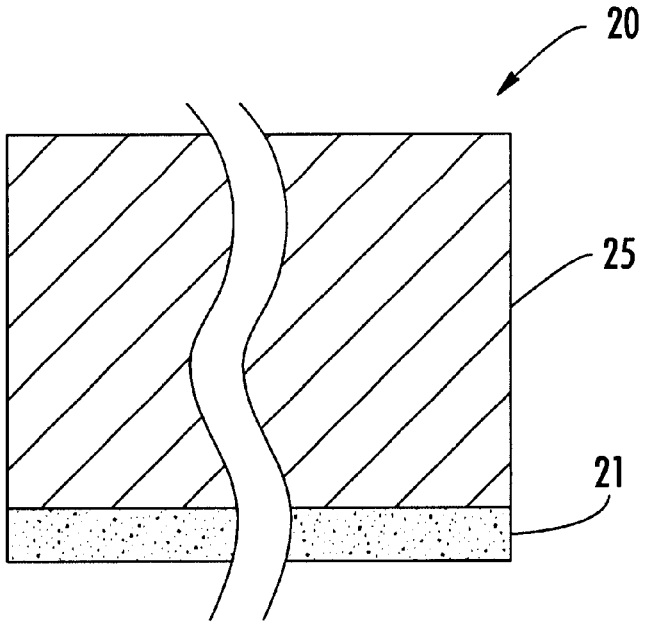
FIGS. 5*a* and 5*b* are schematic cross-sectional views of a body comprising a phase shifting material in accordance with the present invention.

As discussed above, each body 20 comprises a phase shifting material having a controllable dielectric constant for causing a phase shift of a signal being conducted through the signal path 18. In one embodiment, the body 20 comprises a substrate 21 with a layer of the phase shifting material 25 thereon, as best shown in FIG. 5*a*. The substrate 21 may be either conductive or nonconductive.

The layer of the phase shifting material 25 may be bonded or deposited to the substrate 21 using techniques readily known by one skilled in the art. The substrate 21 has a thickness such that the body 20 may be handled by personnel and production machinery without breakage. This thickness is typically greater than 1 mil or 0.001 inches, for example. The overall thickness of the body 20 including the substrate 21 and the layer of the phase shifting material 25 is greater than or equal to 2 mils or 0.002 inches, and typically may be within a range of about 0.002 to 0.2 inches, for example.

The thickness of the layer of the phase shifting material 25 may be either thin film or thick film. Thin film has a thickness of typically a few microns. Thick film has a thickness greater than 0.001 inches, with a typical thickness in a range of about 0.001 to 0.005 inches, for example.

Figure 5B:
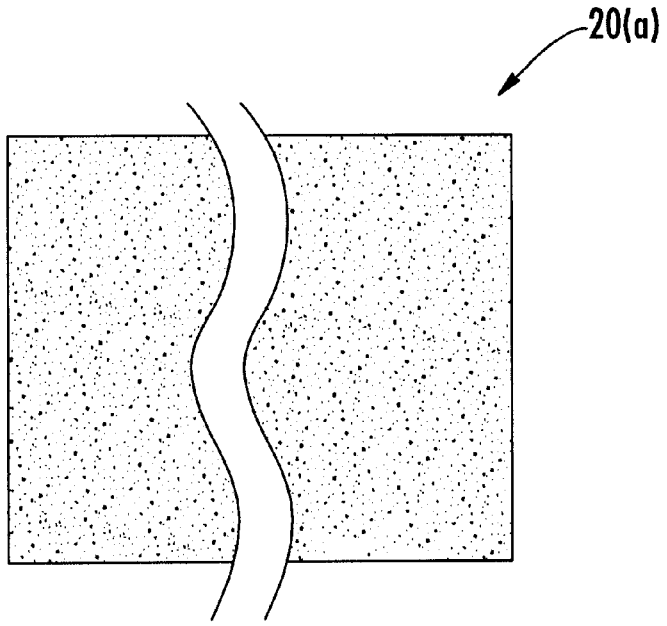

In another embodiment, the body 20(*a*) comprises a bulk phase shifting material body, as best shown in FIG. 5*b*. In other words, the body 20(*a*) is completely formed by a phase shifting material without a substrate being attached thereto. For each of the bodies 20 and 20(*a*) illustrated in FIGS. 5*a*–5*b*, a width is typically within a range of about 0.1 to 0.2 inches and a length is typically within a range of about 0.1 to 0.8 inches. The substrate 21 may be conductive, i.e., a metal, or may be nonconductive, i.e., a dielectric.

The use of a body 20 comprising a phase shifting material instead of a thin film phase shifting material body offers several advantages, particularly in terms of cost. Since the body 20 has an overall thickness greater than about 2 mils, i.e., 0.002 inches, the term "bulk" is used to emphasize a distinction over a "thin film" phase shifting material which typically has a thickness in the several micron range or less. The bulk characteristic of the body 20 allows the phased array antenna 10 to be built with the body being placed and bonded over the first conductive portions 18 using standard printed circuit surface mount machinery.

The substrate 16, the first conductive portion 18 and the at least one second conductive portion 22 can advantageously be formed using printed wiring board techniques, for example. Because the body 20 has a thickness that is relatively easy to handle, it is simply bonded to the printed wiring board in the appropriate place to define a phase shifter 14*a*. Consequently, instead of individually building the phase shifters 14*a*, 14*b* . . . 14*n* and combining them together to form the phased array antenna 10, the phased array antenna may be built in its entirety by forming the first conductive portions 18 on the substrate 16 and then bonding the bodies 20 thereto. The phased array antenna 10 according to the present invention may be scaled to any desired size, for example.

In forming the phased array antenna 10, each body 20 can be loaded into production surface mount or similar machines just as other surface mounted components are loaded. This allows construction of a much lower cost phased array antenna 10. For example, a typical 100 element array operating at 10 GHz using conventional techniques may cost over $2,000 per element. A projected cost of $50 per element is anticipated using a body 20 comprising a phase shifting material. The present invention is thus very adaptable to mass production using techniques as readily understood by one skilled in the art.

A typical dielectric constant of a coplanar waveguide is between about 2 to 4, and a typical dielectric constant of the phase shifting material of each body 20 may range between about 100 to 1,000 or more. A high dielectric constant tends to concentrate fringing fields from the RF signal paths to maximize the effect of the phase shifting material.

The phase shifting material preferably comprises a ferroelectric material, such as barium strontium titanate $Ba_xSr_{1-x}TiO_3$ or other nonlinear materials. These other nonlinear materials include $BaTiO_3$, $LiNbO_3$ and $Pb(Sr,Ti)O_3$, for example. The dielectric constant of the ferroelectric material can be made to vary significantly by applying a DC voltage thereto. The propagation constant of a signal path is directly proportional to the square root of the effective dielectric assuming a lossless dielectric.

Figure 2C:
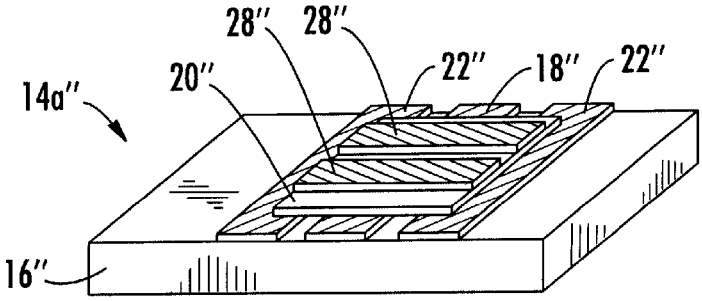

In addition, the phase shifting material may also comprise a ferromagnetic material. Moreover, the phase shifter 14*a*″ may also comprise at least one conductive element 28" on the body 20" comprising a phase shifting material, as best shown in FIG. 2*c*. The conductive element 28" has an effect of slowing down the RF signal being propagated through the first conductive portion 18" or signal path. Referring to FIG. 2*c*, the at least one conductive element 28" illustratively includes a pair of conductive elements laterally spaced apart. The pair of conductive elements 28" are for illustrative purposes only, and other configurations and/or arrangements are acceptable.

In yet another embodiment of the phase shifter that is not shown in the figures, the body 20 may be placed or bonded to the substrate 16 before the first conductive portions 18 are formed.

Figure 3:
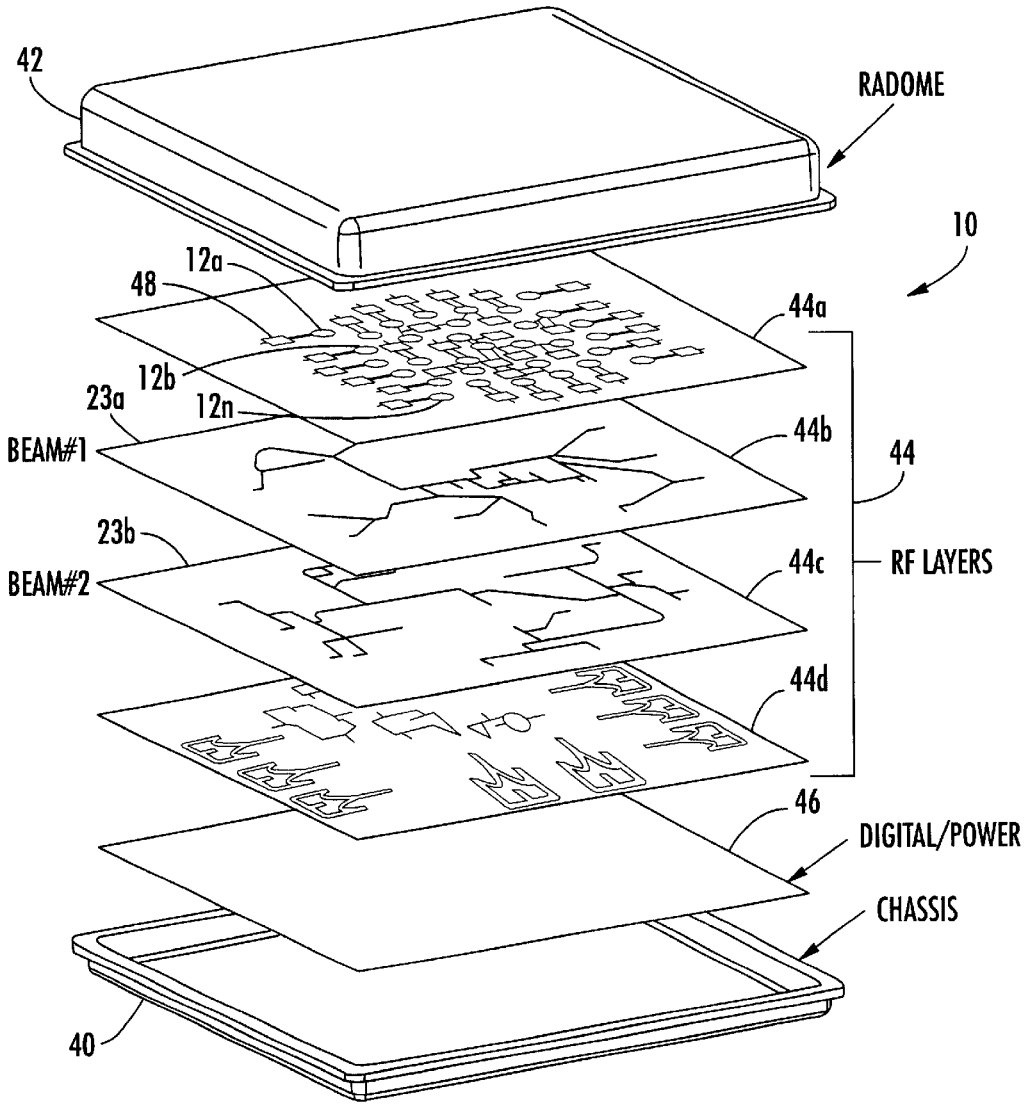
FIG. 3 is an exploded perspective view of a phased array antenna in accordance with the present invention.
Figure 4:
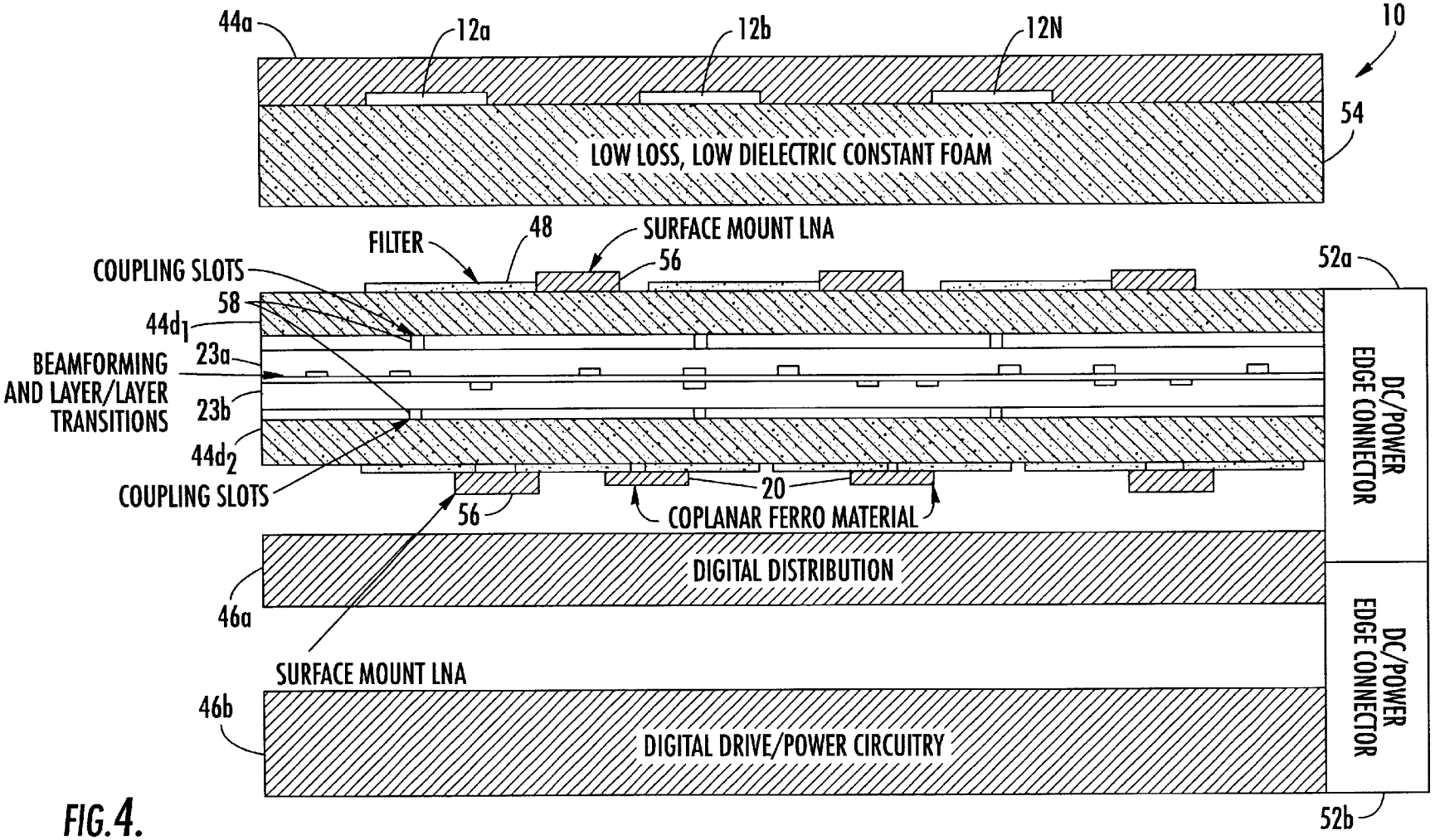
FIG. 4 is a schematic cross-sectional view of a phased array antenna in accordance with the present invention.

Referring now to FIGS. 3 and 4, a mechanical layout and packaging of the phased array antenna 10 will be discussed in greater detail. The phased array antenna 10 is enclosed by a lower chassis 40 and a radome cover 42, as best shown in FIG. 3. The phased array antenna 10 is divided into an RF section 44 and a digital/power 46 section. In the illustrated mechanical layout, the first RF layer 44*a* includes the antenna elements 12*a*, 12*b* . . . 12*n* and filters 48 (see FIG. 3).

The second and third RF layers 44*b* and 44*c* (see FIG. 3) include the beamforming network 23*a*, 23*b* for controlling transmitted and received RF signals through each of the individual antenna elements 12*a*–12*n* and for controlling application of a voltage to the phase shifting material for each of the bodies 20 for transmitting and receiving RF signals in a desired direction. In this particular embodiment, two beamforming networks 23*a* and 23*b* are included for simultaneously forming separate antenna beams. A phase shift layer 44*d* including the bodies 20 and low noise amplifiers (LNAs) interfaces with the other RF layers 44*a*, 44*b* and 44*c* (see FIG. 3). The digital/power layer 46 provides power to the phased array antenna 10 and also interfaces with a transceiver externally positioned with respect to the phased array antenna 10.

More specifically, packaging of the RF layer 44 and the digital/power layer 46 includes connecting to DC/power edge connectors 52*a* and 52*b*, as best shown in FIG. 4. The digital/power layer 46 is divided into a digital distribution layer 46*a* and a digital drive/power circuitry layer 46*b*. These two layers each comprise a printed circuit board with side edge connectors.

The antenna elements 12*a*, 12*b* and 12*n* are packaged in the uppermost RF layer 44*a*, which includes spatial filters 48 and polarizers. A low loss, low dielectric constant foam 54 separates the antenna elements 12*a*–12*n* from the other RF layers 44*b*–44*d*. Each of the other RF layers 44*b*–44*d* includes a printed circuit board with side edge connectors for connection to DC/power edge connector 52*a* as shown in FIG. 4.

Still referring to FIG. 4, the beam forming networks 23*a*, 23*b* are packaged between the phase shift layer 44*d*, which has been divided in a first phase shift layer 44*d*1 and a second phase shift layer 44*d*2. As discussed above, each phase shift layer includes LNAs 56, the bodies 20, and also filters 48, with are bonded to the respective substrates, i.e., printed wiring boards, using production surface mount or similar machines. This allows construction of a much lower cost phased array antenna 10. The RF signal is communicated to the beam forming networks 23*a*, 23*b* through coupling slots 58.

Another aspect of the invention relates to a method for making a phase shifting device comprising a substrate 16 and a plurality of phase shifters 14*a*–14*n* on the substrate. The method preferably comprises forming a plurality of first conductive portions 18 on the substrate 16 for defining a plurality of signal paths, and positioning a plurality of bodies 20 adjacent the plurality of signal paths.

Figure 6:
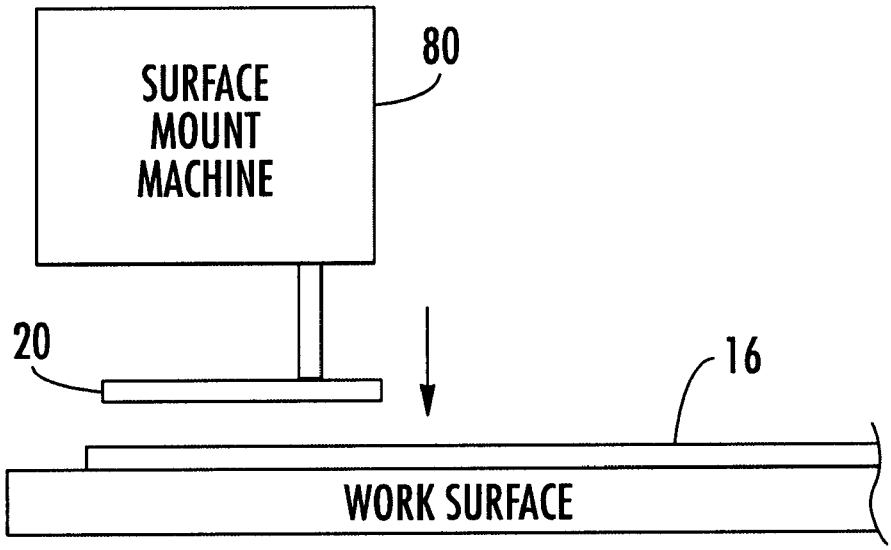
FIG. 6 is a block diagram of a surface mount machine for positioning phase shifting bodies on a substrate in accordance with the present invention.

The plurality of bodies 20 are preferably laterally spaced apart from one another and comprise a phase shifting material having a controllable dielectric constant for causing a phase shift of a signal being conducted through a respective signal path. Positioning of the body 20 may be performed using a surface mount machine 80, as illustrated in FIG. 6. Each body 20 may have a thickness equal to or greater than about 0.002 inches.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A phase shifting device comprising:

a substrate; and a plurality of phase shifters on said substrate, each phase shifter comprising a first conductive portion above said substrate and defining a signal path, and a body above said signal path and comprising a phase shifting material having a controllable dielectric constant for causing a phase shift of a signal being conducted through said signal path;

all respective bodies of adjacent phase shifters being laterally spaced apart from one another.

2. A phase shifting device according to claim 1 wherein each body comprises a body substrate with a layer of said phase shifting material thereon.

3. A phase shifting device according to claim 1 wherein each body comprises a bulk phase shifting material body.

4. A phase shifting device according to claim 1 wherein each body has a thickness equal to or greater than about 0.002 inches.

5. A phase shifting device according to claim 1 wherein each phase shifter further comprises a pair of laterally spaced apart second conductive portions along opposing sides of a respective signal path for defining a ground structure.

6. A phase shifting device according to claim 5 wherein each body is further above a respective pair of second conductive portions.

7. A phase shifting device according to claim 1 wherein each phase shifter further comprises a second conductive portion vertically spaced from a respective signal path for defining a ground structure.

8. A phase shifting device according to claim 1 wherein each phase shifting material comprises a ferroelectric material.

9. A phase shifting device according to claim 8 wherein each ferroelectric material comprises at least one of $BaTiO_3$, $LiNbO_3$ and $Pb(Sr,Ti)O_3$.

10. A phase shifting device according to claim 1 wherein each phase shifting material comprises a ferromagnetic material.

11. A phase shifting device according to claim 1 wherein each phase shifting material comprises barium strontium titanate.

12. A phase shifting device according to claim 1 wherein each phase shifting material has a dielectric constant equal to or greater than about 100.

13. A phase shifting device according to claim 1 wherein each signal path has an operating frequency equal to or greater than about 1 GHz.

14. A phase shifting device according to claim 1 wherein each phase shifter further comprises at least one conductive element on a respective phase shifting material.

15. A phased array antenna comprising:

a plurality of antenna elements;

a phase shifting device connected to said plurality of antenna elements, said phase shifting device comprising a substrate, and a plurality of phase shifters on said substrate, each phase shifter comprising a first conductive portion above said substrate and defining a signal path, and a body above said signal path and comprising a phase shifting material having a controllable dielectric constant for causing a phase shift of a signal being conducted through said signal path, all respective bodies of adjacent phase shifters being laterally spaced apart from one another.

16. A phased array antenna according to claim 15 wherein each body comprises a body substrate with a layer of said phase shifting material thereon.

17. A phased array antenna according to claim 15 wherein each body comprises a bulk phase shifting material body.

18. A phased array antenna according to claim 15 wherein each body has a thickness equal to or greater than about 0.002 inches.

19. A phased array antenna according to claim 15 further comprising a summing network connected to said phase shifting device for adding together signals received by said plurality of antenna elements.

20. A phased array antenna according to claim 15 further comprising a beam forming network connected to said phase shifting device for controlling a voltage applied to each phase shifting material for controlling a respective dielectric constant thereof.

21. A phased array antenna according to claim 15 wherein each phase shifter further comprises a pair of laterally spaced apart second conductive portions along opposing sides of a respective said signal path for defining a ground structure.

22. A phased array antenna according to claim 21 each body is further above a respective pair of second conductive portions.

23. A phased array antenna according to claim 15 wherein each phase shifter further comprises a second conductive portion vertically spaced from a respective signal path for defining a ground structure.

24. A phased array antenna according to claim 15 wherein each phase shifting material comprises a ferroelectric material.

25. A phased array antenna according to claim 24 wherein each ferroelectric material comprises at least one of $BaTiO_3$, $LiNbO_3$ and $Pb(Sr,Ti)O_3$.

26. A phased array antenna according to claim 15 wherein each phase shifting material comprises a ferromagnetic material.

27. A phased array antenna according to claim 15 wherein each phase shifting material comprises barium strontium titanate.

28. A phased array antenna according to claim 15 wherein each phase shifting material has a dielectric constant equal to or greater than about 100.

29. A phased array antenna according to claim 15 wherein each signal path has an operating frequency equal to or greater than about 1 GHz.

30. A phased array antenna according to claim 15 wherein each phase shifter further comprises at least one conductive element on a respective phase shifting material.

31. A method for making a phase shifting device comprising a substrate and a plurality of phase shifters on the substrate, the method comprising:

forming a plurality of first conductive portions above the substrate for defining a plurality of signal paths; and positioning a plurality of bodies above the plurality of signal paths, all respective bodies of adjacent phase shifters being laterally spaced apart from one another and comprising a phase shifting material having a controllable dielectric constant for causing a phase shift of a signal being conducted through a respective signal path.

32. A method according to claim 31 further comprising forming a second conductive portion vertically spaced from each respective signal path for defining a ground structure.

33. A method according to claim 31 wherein each phase shifting material comprises a ferroelectric material.

34. A method according to claim 33 wherein each ferroelectric material comprises at least one of $BaTiO_3$, $LiNbO_3$ and $Pb(Sr,Ti)O_3$.

35. A method according to claim 31 wherein each phase shifting material comprises a ferromagnetic material.

36. A method according to claim 31 wherein each phase shifting material comprises barium strontium titanate.

37. A method according to claim 31 wherein each phase shifting material has a dielectric constant equal to or greater than about 100.

38. A method according to claim 31 wherein each signal path has an operating frequency equal to or greater than about 1 GHz.

39. A method according to claim 31 further comprising at least one conductive element on a respective phase shifting material.

40. A method according to claim 31 further comprising forming a respective pair of laterally spaced apart second conductive portions along opposing sides of each respective path for defining a ground structure.

41. A method according to claim 31 wherein positioning the plurality of bodies further comprises positioning the positioning of bodies adjacent the respective pair of second conductive portions.

42. A method according to claim 31, wherein positioning each body is performed using a surface mount machine.

43. A method according to claim 31 wherein each body comprises a body substrate with a layer of the phase shifting material thereon.

44. A method according to claim 31 wherein each body comprises a bulk phase shifting material body.

45. A method according to claim 31 wherein each body has a thickness equal to or greater than about 0.002 inches.

* * * * *